US007104182B2

(12) United States Patent
Reininger

(10) Patent No.: US 7,104,182 B2
(45) Date of Patent: Sep. 12, 2006

(54) CONTRACTILE UNIT HAVING A POSITION SENSOR MEANS

(75) Inventor: Thomas Reininger, Wernau (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 10/513,014

(22) PCT Filed: May 9, 2003

(86) PCT No.: PCT/EP03/04859

§ 371 (c)(1),
(2), (4) Date: Oct. 28, 2004

(87) PCT Pub. No.: WO03/104659

PCT Pub. Date: Dec. 18, 2003

(65) Prior Publication Data

US 2005/0139063 A1 Jun. 30, 2005

(30) Foreign Application Priority Data

Jun. 7, 2002 (DE) ..... 102 25 246

(51) Int. Cl.
*F01B 31/12* (2006.01)

(52) U.S. Cl. ..... 92/5 R; 92/91

(58) Field of Classification Search ..... 92/5 R, 92/89, 90, 91, 92
See application file for complete search history.

(56) References Cited

U.S. PATENT DOCUMENTS 4,375,057 A * 2/1983 Weise et al. ..... 187/394
4,558,953 A * 12/1985 Yamada ..... 356/409
4,860,639 A 8/1989 Sakaguchi
4,868,488 A * 9/1989 Schmall ..... 324/635
4,901,628 A * 2/1990 Krage ..... 92/5 R
4,987,823 A * 1/1991 Taplin et al. ..... 92/5 R
5,052,273 A * 10/1991 Sakaguchi ..... 92/5 R
5,218,280 A 6/1993 Edwards
5,351,602 A 10/1994 Monroe
6,445,191 B1 * 9/2002 Trummer ..... 324/635
6,445,193 B1 * 9/2002 Trummer et al. ..... 324/644

FOREIGN PATENT DOCUMENTS

| | | | |
|---|---|---|---|
| DE | 3116333 | C2 | 11/1982 |
| DE | 19807593 | A1 | 2/1999 |
| DE | 19833220 | A1 | 6/1999 |
| DE | 29906626 | U1 | 8/1999 |
| DE | 29908008 | U1 | 9/1999 |
| DE | 20112633 | U1 | 3/2002 |
| EP | 0161750 | A1 | 11/1985 |
| EP | 1190819 | A1 | 3/2002 |
| GB | 2089890 | A | 6/1982 |

* cited by examiner

*Primary Examiner*—Edward K. Look
*Assistant Examiner*—Michael Leslie
(74) *Attorney, Agent, or Firm*—Hoffmann & Baron, LLP

(57) ABSTRACT

A contractile unit comprising a contractile hose extending between two spaced head pieces and adapted to perform a longitudinal contraction on being subjected to internal pressure, and a position sensor means responsive to the distance between the head pieces. The position sensor means possesses a microwave generator arranged on one of the head pieces and adapted to emit microwaves into the interior space of the contractile unit, an evaluating means being provided responsive to the distance between the head pieces using transit time measurement, phase comparison of the emitted and reflected wave or using determination of the resonant frequency.

10 Claims, 1 Drawing Sheet

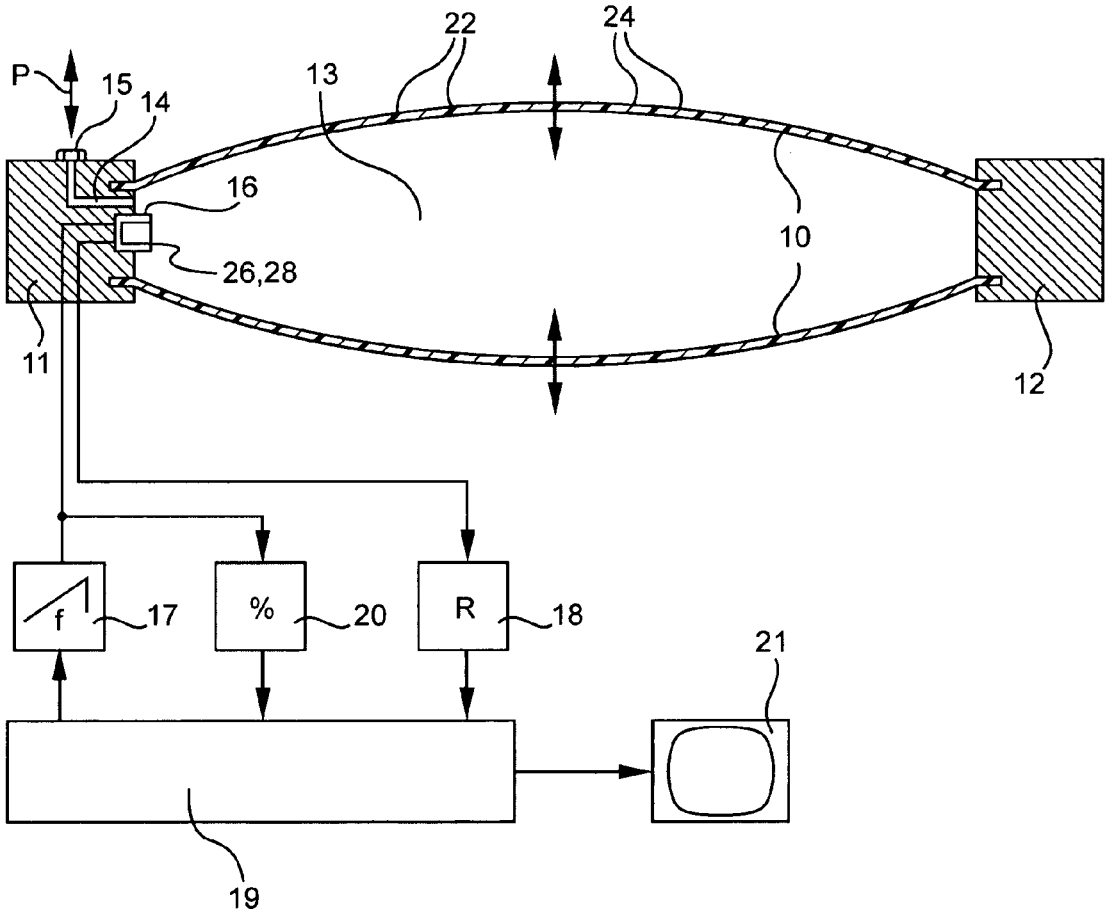
P
15
14
13
22
24
16
26,28
10
11
12
f
17
%
20
R
18
21
19

CONTRACTILE UNIT HAVING A POSITION SENSOR MEANS

This application is a National Phase application of International Application No. PCT/EP03/04859 filed May 9, 2003, which claims priority based on German patent application No. 102 25 246.7 filed on Jun. 7, 2002, which are incorporated herein by reference.

FIELD OF THE INVENTION

The invention relates to a contractile unit comprising a contractile hose extending between two spaced apart head pieces and adapted to perform a longitudinal contraction.

BACKGROUND OF THE INVENTION

Such contractile units are for example disclosed in the assignee's brochure "Fluidic Muscle", the European patent publication 0 161 750 B1, the German patent publication (utility model) 29,906,626, the German patent publication (utility model) 29,908,008 or the German patent publication (utility model) 20,112,633 and are suitable for highly exact positioning while having a simple and low-wear structure involving relatively low costs. Extremely high setting forces may be produced.

For precise positioning position sensors or angle sensors are required in principle for all servo systems. In conjunction with servo cylinders a plurality of such position sensors and sensor means is available which are based on the most various different principles of measurement. In the case of contractile units of the above noted type the same are however for the most part unsuitable or badly suited.

SUMMARY OF THE INVENTION

One object of the present invention is accordingly to create a position sensor means which is highly suitable for such contractile units and is able to be produced simply and at a low cost while ensuring high accuracy.

This aim is to be attained by a contractile unit with a position sensor means, which comprises the features of claim 1.

The advantages of the design in accordance with the invention are more particularly that such a microwave generator, which is already commercially available at an extremely low price in a miniaturized form, may be very easily mounted on the inner side of one of the head pieces or may be integrated in one of the head pieces. Owing to the arrangement in the interior space of the contractile unit without external measuring elements the compactness of the contractile unit is not reduced and mechanical damage or interference is excluded as regards the position sensor means to a substantial extent. One of the principal advantages of such contractile units, namely the complete sealing and accordingly the small amount of working fluid needed, is not impaired by the position sensor means. The measurement of the distance between the head pieces and accordingly the detected position may be performed with great accuracy.

Further advantageous developments of the contractile unit as defined in claim 1 are indicated in the dependent claims.

The microwave generator is advantageously also designed as a microwave receiver so that the reflected microwaves may be detected using the same compact component. This results in a simplification of the electrical connections of the position sensor means.

In accordance with an advantageous design the evaluating means comprises means for phase comparison of the emitted microwave signal and of the microwave signal reflected at the oppositely placed metallic head piece and furthermore for determination of the phase difference as a measure of the distance. The accuracy of measurement is accordingly in the range of half a wavelength.

In accordance with a further advantageous design of the invention the evaluating means possesses a frequency generator for variably setting the microwave frequency, a resonance detector being provided for the resonant frequency. For this purpose the frequency generator is preferably designed in the form of a ramp generator operating in such a manner that on detection of the resonant frequency by the resonance detector and frequency involved is then stored or held as the measurement of the distance. To simplify evaluation a frequency reducer is provided for the resonant frequency in the evaluation means.

The contractile hose is preferably provided with electrically conductive particles or strand elements such as wires, are provided so that the entire contractile unit contributes to influencing the resonant frequency and the entire contractile unit may serve as a microwave wave guide.

According to a convenient design, the microwave generator is designed as a coupled probe transmitting and receiving microwaves. As an alternative to this, the microwave generator may also be designed as a cavity resonator with a resonance space open toward the oppositely placed head piece of the contractile unit. This provides a satisfactory focussing or directionality of the emitted microwave beam.

BRIEF DESCRIPTION OF THE DRAWINGS

One working example of the invention is represented in the drawing and described in [2]detail in the following account. The single FIGURE shows a contractile unit or element unit in longitudinal section, one of the head pieces being provided with a cavity resonator as a position sensor means.

DESCRIPTION OF THE PREFERRED EMBODIMENTS

The contractile element is only diagrammatically represented in the single figure for simplification. A more detailed representation is to be found for example in the initially mentioned German patent publication (utility model) 29,906,626. A contractile hose 10 of an elastic rubber or plastic material is sealed off both ends by head pieces 11 and 12. In the wall of the contractile hose 10, there is a conventional flexible strand structure which is not illustrated to simplify the drawing and which in the present case may consist of metallic strand structures 22 in order to let the contractile unit function as a microwave wave guide. The wall can also comprise other metallic conductive particles 24. The connection of the contractile hose 10 with the two head pieces 11 and 12 is such that the contractile hose 10 provided with the strand structure 22 is able to transmit tension forces to the respective head piece 11 and 12. The attachment may for example be as part of a clamping connection as is described by way of example in the said European patent publication 0 161 750 B1. Other attachment means are also possible.

Into the interior space 13 delimited by the contractile hose 10 and the two head pieces 11 and 12 there opens a fluid duct 14, that extends through one of the head pieces 11 and whose outer end is provided with a connection means 15, by way of which a fluid line, extending from a pressure source, may be connected. In principle several fluid ducts could be provided as well. In connection with a control valve arrangement, not illustrated, there is accordingly the possibility of supplying and removing a fluid pressure medium through the fluid duct 14 into the interior space 13 and from such space.

The figure shows the contractile hose 10 in the activated state, that is to say with the interior space 13 subject to pressure. In this state the contractile hose 10 is radially expanded and simultaneously axially contracted so that the two head pieces 11 and 12 are moved together axially. In the deactivated state, that is to say with the interior space free of pressure, the contractile hose 10 assumes an essentially tubular configuration and the two head pieces 11 and 13 moved away from the one another. It is in this manner that by matched fluid action in the interior space 13 an axial stroke of the head pieces 11 and 12 in relation to one another may be produced.

As a position sensor means for detecting the relative position of the two head pieces 11 and 12, the one head piece 11 is provided at a side facing the interior space with a microwave cavity resonator 16. Same may be attached to the head piece 11 or integrated in it. The cavity resonator 16 possesses a resonance space that is open toward the opposite head piece 12, by means of which microwaves may be emitted toward the opposite head piece 12. There they are reflected and pass back to the cavity resonator 16, which is provided with a suitable detecting means, not illustrated. Such a cavity resonator for measuring the distance is described in the German patent publication 19,807593 A1 so that a detailed representation is not required.

The cavity resonator 16 is driven by a ramp frequency generator 17 so that the frequency is preset. The receiving part of the cavity resonator 16 is connected with a resonance detector 18, which for example comprises a two-stage differentiator and a comparator, and constantly monitors the received signal for resonance. The resonance expresses itself as a steep slope of the receive signal. As soon as an evaluating means 19, connected with the ramp frequency generator 17 and the resonance detector 18, detects resonance, the ramp-like frequency increase is halted and the frequency held. It is reduced using a-frequency divider 20 and communicated to the evaluating means 19 to serve as a measure for the distance apart of the two head pieces 11 and 12.

The resonant frequency is dependent on the distance apart of the two head pieces 11 and 12 and may be also influenced by the conductive wall of the contractile hose 10. For each condition of the contractile element there is a particular resonant frequency so that merely the transmission frequency must be varied in each case until the resonant frequency and the transmission frequency are the same. The receiving means, for example in the form of a detector diode 26, of the cavity resonator 16 recognizes a power drop on the resonant frequency being reached.

A value converted from the respective resonant frequency to represent the distance apart can be indicated on a display 21 and/or evaluated in some other manner.

The frequency generator 17, the resonance detector 18 and the frequency divider 20 may naturally be components of the evaluating means 19 instead of being separate units. Moreover, other evaluating means in accordance with the state of the art are possible.

As an alternative to the cavity resonator 16 the microwave generator arranged on the head piece 11 may also for example be in the form of a coupled probe 28, as is described in more detail in the German patent publication 19,833,220 A1 for measuring the distance. The microwave signal is supplied by way of a coupled probe into the interior space of the contractile element 10, the operation being so performed that in a first step the absolute distance between the entry point on the left head piece 11 and the right head piece 12 is measured, for example by transit time measurement for the frequency modulated transmitted signal. Then a standing wave is produced in the interior space, whose shift is performed by the axial change in length of the two head pieces toward each other. By phase evaluation of the signal, which as regards frequency is reduced in a manner like in the previous example of the invention, the changing distance between the head pieces is measured. In the German patent publication 19,833,330 A1 various working examples are described, which may be employed as alternatives.

The invention claimed is:

1. A contractile unit comprising a contractile hose extending between two spaced head pieces and adapted to perform a longitudinal contraction on being subjected to internal pressure, and a position sensor means responsive to the distance between the head pieces, which possesses a microwave generator arranged on one of the head pieces and adapted to emit microwaves into the interior space of the contractile unit, an evaluating means being provided responsive to the distance between the head pieces, by transit time measurement, by phase comparison of the emitted and reflected wave or by determination of the resonant frequency, the contractile hose comprising at least one of electrically conductive particles, electrically conductive strand elements, and wires.

2. The contractile unit as set forth in claim 1, wherein the microwave generator is also adapted to function as a microwave receiver.

3. The contractile unit as set forth in claim 1, wherein the evaluating means comprises means for phase comparison of the emitted microwave signal and the reflected microwave signal and for phase difference determination as a measure of the distance.

4. The contractile unit as set forth in claim 1, wherein the evaluating means is provided with a frequency generator for variably setting the microwave frequency and in that a resonance detector is provided responsive to the resonant frequency.

5. The contractile unit as set forth in claim 4, wherein the frequency generator is provided in the form of a ramp frequency generator and on detection of the resonant frequency by the resonance detector the present frequency is held as a measure for the distance.

6. The contractile unit as set forth in claim 5, wherein a frequency reducer is provided for the evaluation of the resonant frequency in the evaluating means.

7. The contractile unit as set forth in claim 1, wherein the microwave generator is designed in the form of at least one of a coupled probe and a detector diode transmitting and receiving microwaves.

8. The contractile unit as set forth in claim 1, wherein the microwave generator is designed in the form of a cavity resonator with a resonance space open toward the opposite head piece.

9. The contractile unit as set forth in claim 2, wherein the evaluating means comprises means for phase comparison of the emitted microwave signal and the reflected microwave signal and for phase difference determination as a measure of the distance.

10. The contractile unit as set forth in claim 2, wherein the evaluating means is provided with a frequency generator for variably setting the microwave frequency and in that a resonance detector is provided responsive to the resonant frequency.

* * * * *